US007695203B2

(12) United States Patent
Takayama et al.

(10) Patent No.: US 7,695,203 B2
(45) Date of Patent: Apr. 13, 2010

(54) INFORMATION PROCESSING APPARATUS, PRINTING AND EMBOSSING COMPLEX APPARATUS, DELETE MENU DISPLAY METHOD OF INFORMATION PROCESSING APPARATUS AND PROGRAM

(75) Inventors: Shoji Takayama, Azumino (JP); Makoto Takada, Shiojiri (JP); Seiji Tanaka, Azumino (JP); Takayuki Uehara, Keshigoya (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 1036 days.

(21) Appl. No.: 11/399,959

(22) Filed: Apr. 6, 2006

(65) Prior Publication Data

US 2006/0228146 A1 Oct. 12, 2006

(30) Foreign Application Priority Data

Apr. 8, 2005 (JP) ..... 2005-112291

(51) Int. Cl.
*B41J 3/32* (2006.01)

(52) U.S. Cl. ..... 400/109.1; 400/88; 400/109

(58) Field of Classification Search ..... 400/88, 400/109, 109.1
See application file for complete search history.

(56) References Cited

U.S. PATENT DOCUMENTS 5,627,578 A * 5/1997 Weintraub ..... 347/101
6,396,518 B1 * 5/2002 Dow et al. ..... 715/772

FOREIGN PATENT DOCUMENTS

JP 10-000818 1/1998
JP 2001-088358 4/2001

* cited by examiner

*Primary Examiner*—Ren Yan
*Assistant Examiner*—Matthew G Marini
(74) *Attorney, Agent, or Firm*—Hogan & Hartson LLP

(57) ABSTRACT

An information processing apparatus includes an input device which allows input of a plurality of information so as to allow performance of a plurality of processes, an input information display device that displays input information that is the input one or more kinds of information, a delete menu storage device that stores a delete menu having a plurality of delete options, and a delete menu display device that displays only delete options corresponding to the information input by the input device from among the plurality of delete options, as the delete menu.

5 Claims, 9 Drawing Sheets

(Note: Braille characters correspond to the Japanese characters of EIGYO meaning business in English.)

TEXT EDITING SCREEN

TEXT EDITING SCREEN (NO INPUT)

EXAMPLE FOR ONLY INK CHARACTER INFORMATION :

BRAILLE INFORMATION : NO INPUT

INK CHARACTER INFORMATION : KAIGISHITSU(PARAGRAPH 1)
FIRST (PARAGRAPH 2 ; FIRST ROW)
SECOND(PARAGRAPH 2 ; SECOND ROW)

EXAMPLE FOR ONLY BRAILLE INFORMATION :

BRAILLE INFORMATION : KAIGISHITSU

INK CHARACTER INFORMATION : NO INPUT

Fig. 9A

INK CHARACTER INFORMATION AND BRAILLE INFORMATION AND
EXAMPLE WHEN CURSOR IS LOCATED IN LETTER STRING OF BRAILLE INFORMATION :

BRAILLE INFORMATION : KAIGISHITSU

INK CHARACTER INFORMATION : KAIGISHITSU
(PARAGRAPH 1)
first (PARAGRAPH 2;FIRST ROW)
second (PARAGRAPH 2;SECOND ROW)

CURSOR LOCATION : BRAILLE

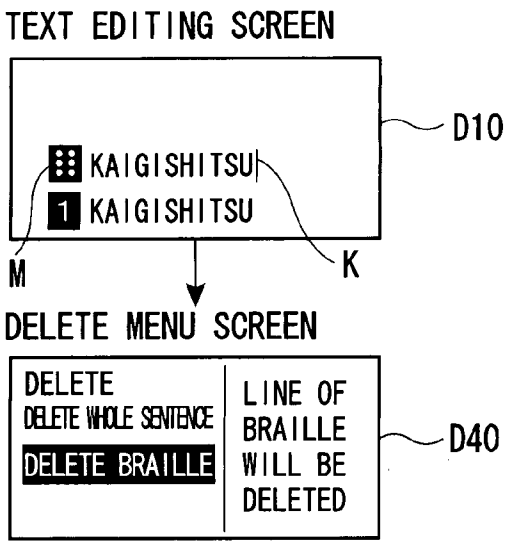

Fig. 9B

INK CHARACTER INFORMATION AND BRAILLE INFORMATION AND
EXAMPLE WHEN CURSOR IS LOCATED IN LETTER STRING OF INK CHARACTER INFORMATION :

BRAILLE INFORMATION : KAIGISHITSU

INK CHARACTER INFORMATION : KAIGISHITSU
(PARAGRAPH 1)
first (PARAGRAPH 2;FIRST ROW)
second (PARAGRAPH 2;SECOND ROW)

CURSOR LOCATION : INK CHARACTER

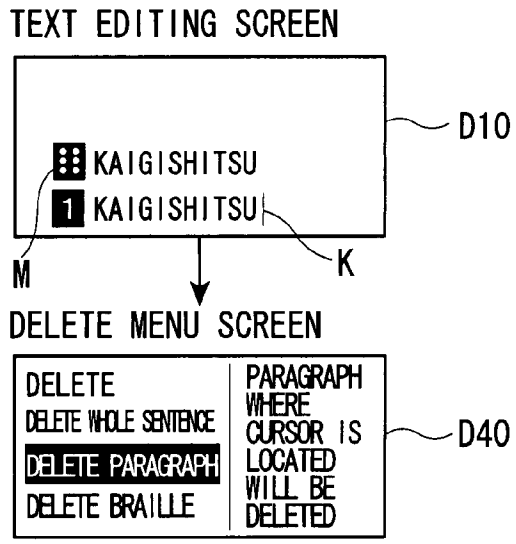

INFORMATION PROCESSING APPARATUS, PRINTING AND EMBOSSING COMPLEX APPARATUS, DELETE MENU DISPLAY METHOD OF INFORMATION PROCESSING APPARATUS AND PROGRAM

The entire disclosure of Japanese Patent Application No. 2005-112291, filed Apr. 8, 2005, is expressly incorporated by reference herein.

BACKGROUND

1. Technical Field

The present invention relates to an information processing apparatus for processing various kinds of input information, to a printing and embossing complex apparatus, to a delete menu display method of the information processing apparatus, and to a program.

2. Related Art

In the related art, a label making apparatus that prints given information on a tape as ink characters and makes labels is known (for example, see JP-A-10-00818). In addition, a Braille label making apparatus which makes Braille labels by performing both an ink character printing process and a Braille embossing process such that visually impaired people and people with normal vision can recognize the labels is also known (for example, see JP-A-2001-88358). Furthermore, in the Braille label making apparatus, generous labels can be separately made by either performing only the ink character printing process without performing the Braille embossing process, or Braille labels can be made by performing only the Braille embossing process without performing the ink character printing process.

The label making apparatus has a function for deleting input information by using various options in accordance with a user's request so as to improve user operationality. For example, the label making apparatus displays a delete menu including a plurality of options such that the whole input information is batch-deleted or only some of the sections are selectively deleted, thus allowing a user to select a desired option. From the above fact, it can be easily assumed that the Braille label making apparatus may also have such a function.

In the Braille label making apparatus, however, various kinds of information, such as ink character printing information and Braille embossing information, are input according to the apparatus characteristics. That is, the delete menu includes options, such as 'whole information will be deleted', 'ink character printing information will be deleted', and 'braille embossing information will be deleted'. A user can select a desired option from among the plurality of options. In this case, for controlling the apparatus, it is natural that the menu for deleting information that has not been input cannot be selected, but a user, in particular, a user who has not experienced the input manipulation of the label making apparatus may be confused as to why some of the delete menus cannot be selected.

SUMMARY

An advantage of some aspects of the invention is that it provides an information processing apparatus in which a user can select a desired option of a delete menu without being confused while operating an information processing apparatus for processing various kinds of input information, a printing and embossing complex apparatus, a delete menu display method of the information processing apparatus, and a program.

According to a first aspect of the invention, an information processing apparatus includes an input device which allows input of a plurality of information so as to allow performance of a plurality of processes, an input information display device that displays input information that is the input one or more kinds of information, a delete menu storage device that stores a delete menu having a plurality of delete options, and a delete menu display device that displays only delete options corresponding to the information input by the input device from among the plurality of delete options, as the delete menu.

In a similar way, according to an another aspect of the invention, a method of displaying a delete menu of an information processing apparatus for inputting a plurality of information so as to allow performance of a plurality of processes, displays only delete options corresponding to one or more kinds of information from among a plurality of delete options stored as the delete menu.

In accordance with these constructions, the delete menu display device displays only the delete options for deleting one or more kinds of input information as the delete menu. Accordingly, a user can select any one of the entire displayed delete options. In other words, since delete options that are not displayed are impossible to select, a user who is inexperience in manipulation may select a desired delete option without any confusion.

In this case, it is preferable that the input information display device further display a cursor for marking an editing location of the input information. The delete menu display device may determine the delete options to be displayed on the basis of the location of the cursor, and then displays the delete menu.

In accordance with the above construction, the delete menu is displayed on the basis of a delete option for deleting input information that is to be edited. In other words, only a delete option needed by a user is extracted and is then displayed as the delete menu. It is thus possible to further improve user operability.

Furthermore, in this case, it is preferable that the plurality of information include ink character information for performing ink character printing and Braille information for performing Braille embossing. In addition, the delete menu display device may determine the delete options to be displayed based on whether Braille information exists in the input information, and then displays the delete menu.

In accordance with the above construction, the delete menu display device determines a delete option on the basis of whether Braille information exists and displays the determined delete option as the delete menu. Therefore, in the case where there is no any input of Braille information, control, a delete option for deleting Braille information is not displayed, can be performed. Accordingly, a user can select any one of the entire displayed delete options. In other words, since unselectable delete options are not displayed, a user who has not experienced in operation may select a desired delete option without any confusion.

Furthermore, in this case, it is preferable that the delete menu include delete options such as 'delete whole text' that batch-deletes the input information, 'delete section' that deletes the ink character information on a section basis, and 'delete Braille' that batch-deletes the Braille information. The delete menu display device displays 'delete whole text' and 'delete section' as the delete options only if the ink character information is input as the input information, the delete menu display device displays 'delete whole text' and 'delete Braille' as the delete options only if the Braille information is input as the input information, and the delete menu display device displays 'delete whole text', 'delete section', and 'delete Braille' as the delete options if the ink character information and the Braille information are input as the input information.

In accordance with the above construction, the delete menu display device displays only the delete options for deleting input information of ink character information and Braille information as the delete menu. Therefore, a user can select any one of the displayed delete options. In other words, unselectable delete options are not displayed, a user who has not experienced in the operation may select a desired delete option without any confusion. In addition, even if both the ink character information and the Braille information are input, the entire delete options of 'delete whole text, 'delete section', and 'delete Braille' are displayed. This allows the user to reliably select a desired option.

Furthermore, in these cases, it is preferable that the input information display device further display a cursor for marking an editing location of the input information. In the case that the ink character information and the Braille information are input as the input information, the delete menu display device displays 'delete whole text', 'delete section' and 'delete Braille' as the delete options if the cursor is located at the ink character information, and the delete menu display device displays 'delete whole text' and 'delete Braille' as the delete options if the cursor is located at the Braille information.

In accordance with the above construction, when the ink character information and the Braille information are input as the input information, reference may be further made to the location of the cursor. When the cursor is located at the ink character information, the delete menu may be displayed on the basis of the delete option for deleting the ink character information. When the cursor is located at the Braille information, the delete menu may be displayed on the basis of the delete option for deleting the Braille information. In other words, since a delete option needed only by a user is displayed as the delete menu, the number of delete options to be displayed can be reduced, thereby further improving user operability.

According to another aspect of the invention, a printing and embossing complex apparatus includes the information processing apparatus described above, an ink character printing device that prints ink characters on a processing sheet on the basis of the ink character information, and a Braille embossing device that embosses Braille characters on the processing sheet on the basis of the Braille information.

In accordance with the construction, the ink character printing and the Braille embossing process can be performed on the processing sheet based on ink character information and Braille information input by any one of the above-mentioned information processing apparatuses.

According to another aspect of the invention, a program allows a computer to operate as each device of the information processing apparatus described above.

In accordance with the above construction, a program that allows a user to select a desired option of the delete menu can be provided in the information processing apparatus that processes a plurality of input information.

BRIEF DESCRIPTION OF THE DRAWINGS

The invention will be described with reference to the accompanying drawings, wherein like numbers reference like elements.

FIGS. 9A and 9B are views illustrating a delete menu to be displayed on the basis of the cursor location.

DESCRIPTION OF EXEMPLARY EMBODIMENTS

Hereinafter, an example in which an information processing apparatus according to an embodiment of the invention is applied to a label making apparatus will be described with reference to the accompanying drawings. The label making apparatus includes an ink character printing unit and a Braille embossing unit. The ink character printing unit performs an ink character printing process on a processing tape. The ink character printing unit cuts a printing completed part to obtain a tape piece. The ink character printing unit then manually inserts the obtained tape piece into the Braille embossing unit. The Braille embossing unit performs a Braille embossing process on the tape piece.

Figure 1:
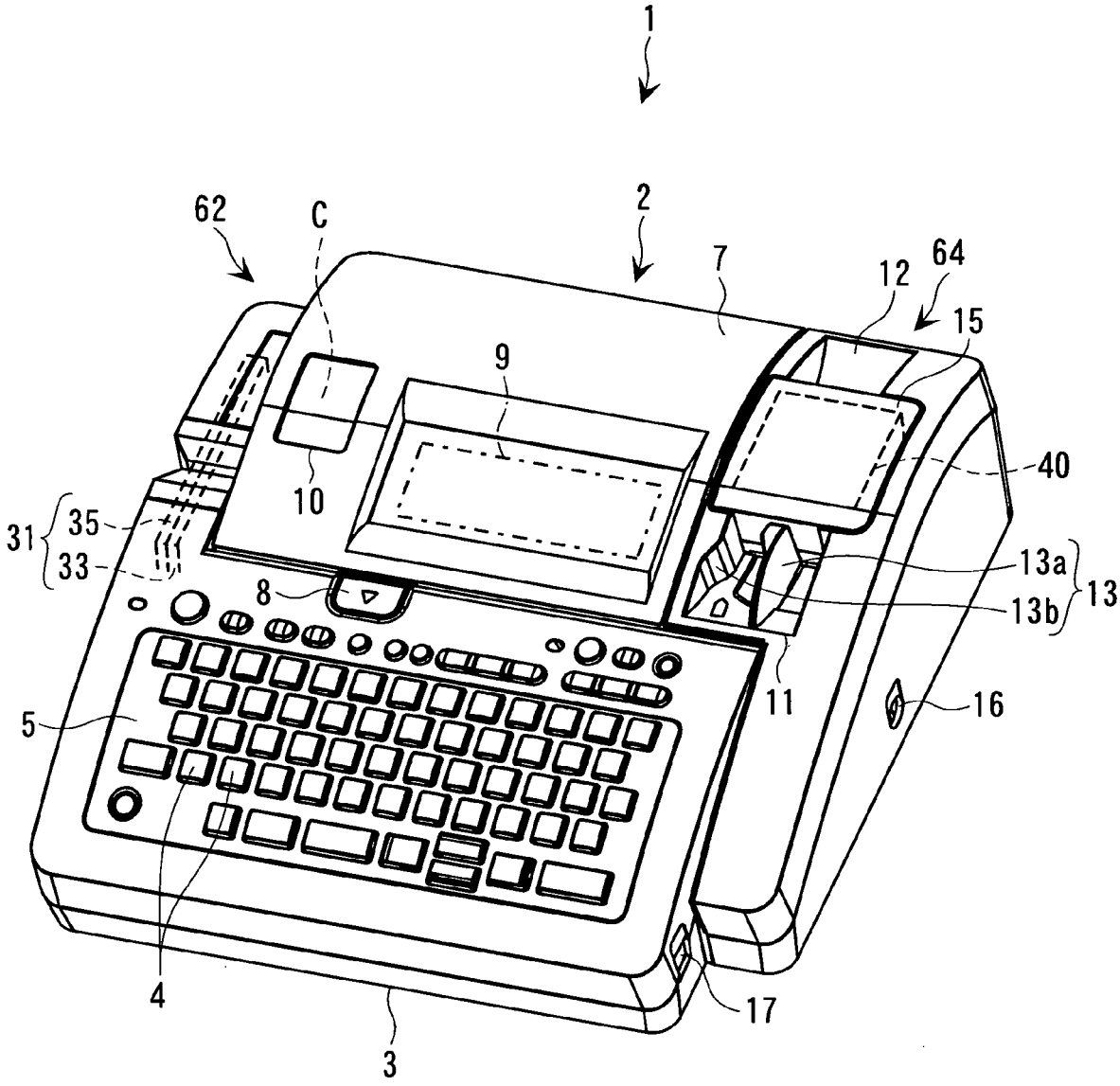
FIG. 1 is an exterior perspective view of a label making apparatus in which a cover is closed.
Figure 2:
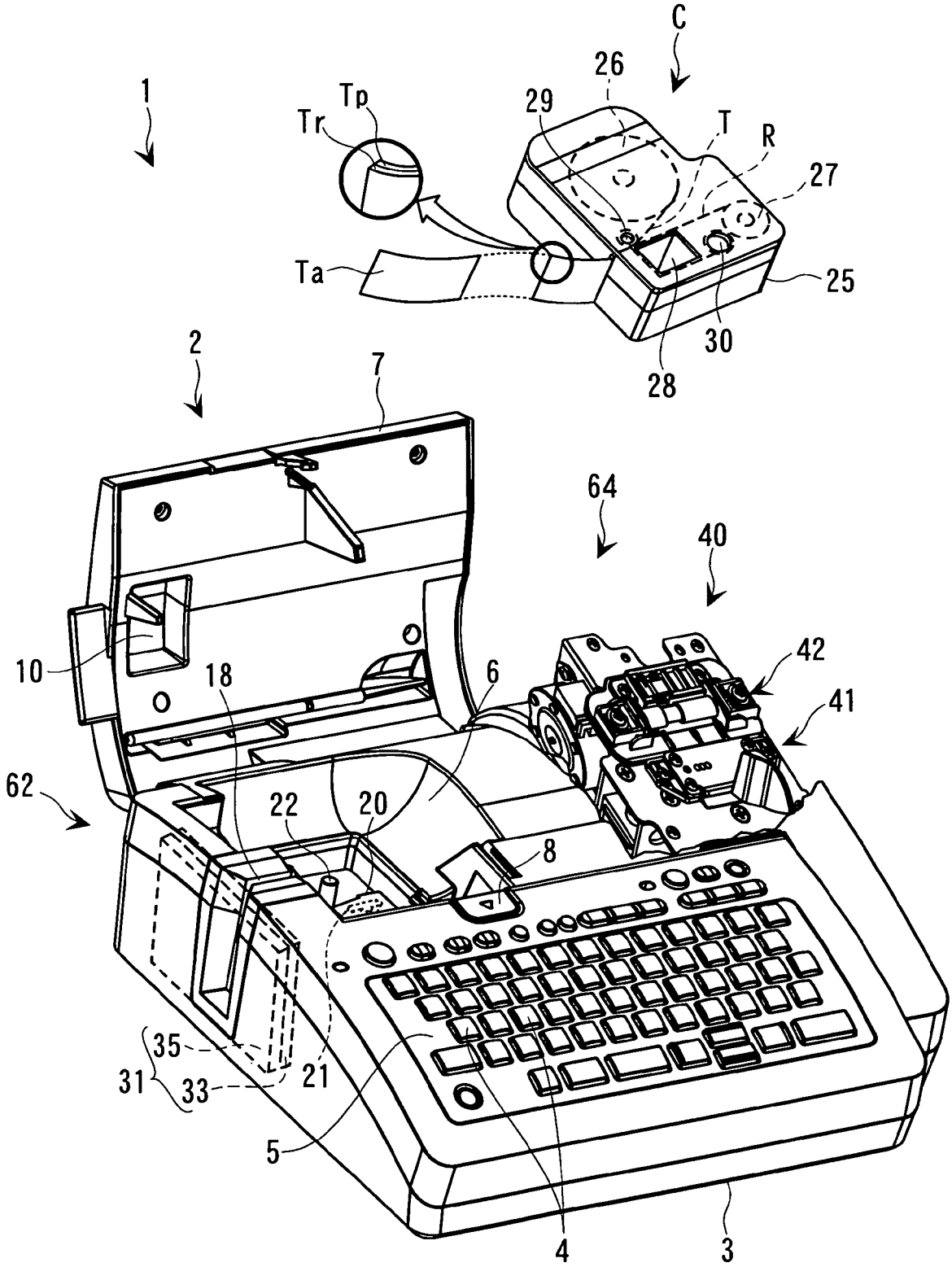
FIG. 2 is an exterior perspective view of the label making apparatus in which a cover is opened.

FIG. 1 is an exterior perspective view of a label making apparatus in which a cover is closed. FIG. 2 is an exterior perspective view of the label making apparatus in which the cover is opened. As shown in FIGS. 1 and 2, the label making apparatus 1 includes an apparatus main body 2 and a tape cartridge C. The apparatus main body 2 performs the Braille embossing process on a tape piece Ta (see FIG. 2), which is obtained from a processing tape T, while performing the ink character printing process on the processing tape T (see FIG. 2). The tape cartridge C includes the processing tape T and an ink ribbon R and is detachably mounted in the apparatus main body 2.

The apparatus main body 2 has a shell formed of an apparatus casing 3. An ink character printing unit 62 is disposed in a large space in the apparatus main body 2. A Braille embossing unit 64 is disposed on the right side of the rear half space of the apparatus casing 3. A keyboard 5 having a plurality of keys 4 is arranged on a top surface in the front half space of the apparatus casing 3. An opening and closing cover 7 is disposed in the rear half space of a top surface of the apparatus casing 3. A cover opening button 8 that opens the opening and closing cover 7 is centrally disposed in the front of the opening and closing cover 7. A rectangular display 9 that displays input results from the keyboard 5 is disposed on a surface of the opening and closing cover 7.

Inside the cover opening button 8, a cartridge mounting unit 6 is formed with a recess so as to hold the tape cartridge C and in which the tape cartridge C. A print head 21 that performs the ink character printing process on the processing tape T, which is reeled out from the tape cartridge C, is disposed within the cartridge mounting unit 6 (see FIG. 2).

A print-tape ejecting slot 18 through which the cartridge mounting unit 6 can communicate to the outside of the apparatus is formed on the left side of the apparatus casing 3. A cutter unit 31 for cutting the processing tape T is positioned so as to come in contact with the print-tape ejecting slot 18 built in the apparatus casing 3. The cutter unit 31 includes a full-cutter 33 and a half-cutter 35. The full-cutter 33 is positioned to come in contact with the print-tape ejecting slot 18 and cuts like scissors the processing tape T by being driven by a motor (a full-cutter motor 32; see FIG. 4) as a cutting device. The half-cutter 35 is positioned in such a way as to be on the downstream side in a direction along which the tape is moved with respect to the full-cutter 33. The half-cutter 35 equipped with a stopper cuts (half-cuts) like scissors only a recording tape Tr to be described later, of the processing tape T, by being driven by a motor (a half-cutter motor 34; see FIG. 4). The half cut causes discarded tape parts (not shown) to be dropped at the leading end of the processing tape T in a direction along which an embossing assembly 40 is inserted.

On the other hand, the Braille embossing unit 64 is disposed on the right side on the top surface of the rear half area of the apparatus casing 3. The Braille embossing unit 64 includes an embossing tape inserting slot (a sheet inserting part) 11 and an embossing tape ejecting slot 12, and the embossing assembly 40 serving as the main body of the Braille embossing unit 64 is inserted between the embossing tape inserting slot 11 and the embossing tape ejecting slot 12. The tape piece Ta is manually inserted into the embossing tape inserting slot 11 from the front side thereof with the printing surface of the tape piece Ta facing upward. The tape piece Ta on which the Braille embossing process has been performed is ejected backward from the embossisng tape ejecting slot 12. A manual guide 13 that can be adjusted to various widths is disposed in the embossing tape inserting slot 11. In FIG. 1, reference numeral 15 corresponds to an embossing unit cover that covers the embossing assembly 40.

A power supply port 16 for supplying power and a connection slot 17 (interface) for connecting an external apparatus, such as a personal computer (not shown), are formed on the right side of the apparatus casing 3. Accordingly, the external apparatus can be connected to the connection slot 17. The ink character printing process or the Braille embossing process can be performed on the basis of character information generated by the external apparatus. In addition, though not shown in FIGS. 1 and 2, a circuit board constituting a control unit 60 (see FIG. 4) for generally controlling the apparatus main body 2 may be mounted in the apparatus casing 3.

In the cartridge mounting unit 6 are projectingly provided the print head 21 having a heat-generating element and covered with a head cover 20, a positioning boss 22 that positions the tape reel 26, a platen driving shaft (not shown) that feeds the processing tape T of the tape cartridge C and the ink ribbon R and comes to contact with the print head 21, and a take-up driving shaft (not shown) for taking up the ink ribbon R. In a corner part of the cartridge mounting unit 6 is disposed a tape identification sensor 23 (see FIG. 4) having a plurality of microswitches. In addition, a printing feed motor 24 (see FIG. 4) for driving the platen driving shaft and the take-up driving shaft or a deceleration gear column (not shown) and so on are formed on a lower plate within the cartridge mounting unit 6.

The tape cartridge C is constructed to hold a tape reel 26 on which the processing tape T is wound, a ribbon pay out reel 27 on which the ink ribbon R is wound on the left side of the tape cartridge C, and a ribbon take-up reel 30 within the cartridge casing 25. A through hole 28 into which the head cover 20 that covers the print head 21 is to be inserted is formed on a lower left side of the tape reel 26. A platen roller 29 is also disposed on the left lower side of the tape reel 26. The platen roller 29 corresponds to a portion at which the processing tape T and the ink ribbon R overlap with each other, and is coupled to the platen driving shaft and then rotated.

If the tape cartridge C is mounted in the cartridge mounting unit 6, the head cover 20 is inserted into the through hole 28, the positioning boss 22 is inserted into the tape reel 26, the take-up driving shaft is inserted into the ribbon take-up reel 30, and the platen driving shaft is also inserted into the platen roller 29. In this state, if the opening and closing cover 7 is closed, the print head 21 is brought in contact with the platen roller 29, sandwiching the processing tape T and the ink ribbon R, such that the mode becomes a print standby mode. Thereafter, while the platen driving shaft and the take-up driving shaft are periodically rotated on the basis of the ink character data from the control unit 60 in response to the character information input by using the keyboard 5, the print head 21 performs the ink character printing process while the processing tape T and the ink ribbon R are fed. The ink ribbon R that has been reeled out from the ribbon pay out reel 27 periodically rotates walls of the through hole 28 and is then wound on the ribbon take-up reel 30. The ink character printing process produces discarded tape portions (not shown) formed by the half-cutter 35. At the same time, a printing completed part of the processing tape T cut by the full-cutter 33 and the cut tape piece Ta is ejected outwardly from the print-tape ejecting slot 18.

The processing tape T includes the recording tape Tr made of PET (PolyEthylene Terephtalate), which has an adhesive layer coated on its back surface, and a peel-off tape Tp adhered to the recording tape Tr by an adhesive layer. The processing tape T is wound in a roll form in which the recording tape Tr faces outward and the peel-off tape Tp faces inward when rolled and is then held within the cartridge casing 25. The processing tape T may have a plurality of different tape widths. A plurality of small holes (not shown) to be detected are formed at the back surface of the cartridge casing C. The tape identification sensor 23 identifies the plurality of holes to be detected in order to determine the type of the processing tape T.

Figure 3A:
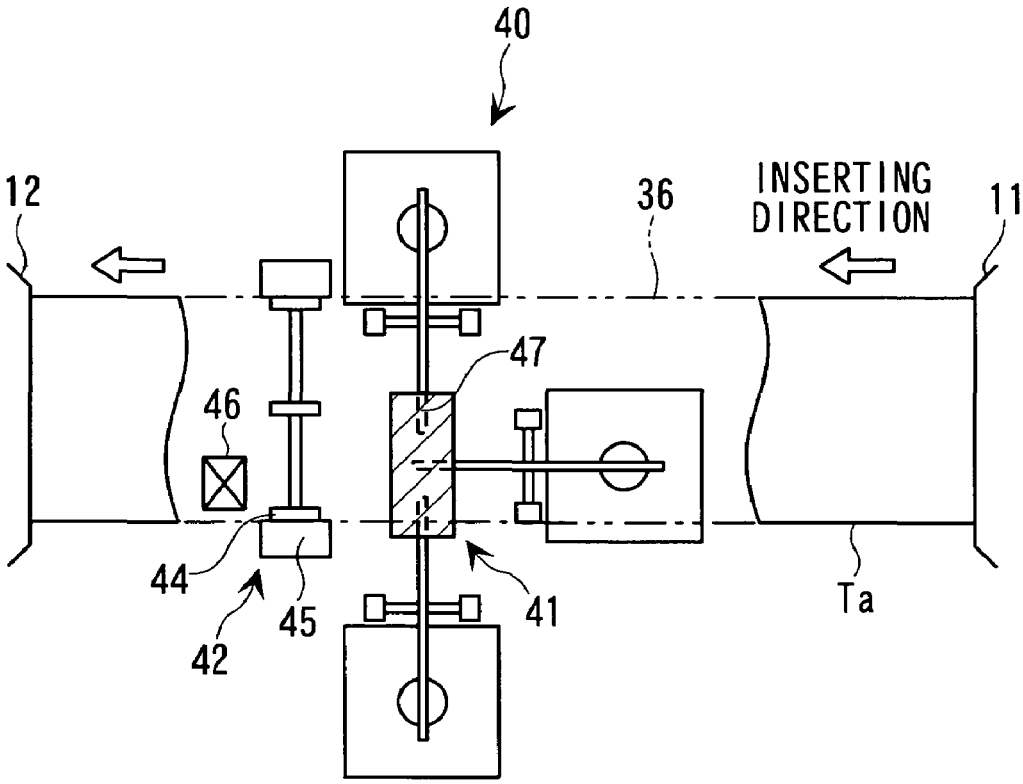
FIGS. 3A and 3B are a plan view and a cross-sectional view of the embossing unit, respectively.

Referring to FIG. 3A, the embossing assembly 40 includes an embossing unit 41 (a Braille embossing unit) and a tape feed unit 42. The embossing unit 41 comes to contact with a tape travel path 36 for connecting the embossing tape inserting slot 11 and the embossing tape ejecting slot 12 on a straight line. The embossing unit 41 is disposed adjacent to the half side of the cartridge mounting unit 6 in a width direction of the tape travel path 36 while performing the Braille embossing process. The tape feed unit 42 feeds the tape piece Ta, which is manually inserted from the embossing tape inserting slot 11, toward the embossing tape ejecting slot 12.

The tape feed unit 42 includes a feed roller 44 that rotates and feeds the tape piece Ta, a roller shaft support unit 45 that rotatably supports the feed roller 44, an embossing feed motor 43 (see FIG. 4) that rotates the feed roller 44 in forward and reverse directions, a power transfer device (not shown) that transfers driving power of the embossing feed motor 43 to the feed roller 44, and a leading end detection mechanism 46 that detects the leading end of the tape piece Ta that has been fed. When the embossing feed motor 43 is driven, it rotates the feed roller 44 to feed the tape piece Ta through the power transfer device. The leading end detection mechanism 46 detects the leading end of the fed tape piece Ta. The embossing unit 41 starts the Braille embossing process on the basis of the detection of the leading end as a trigger.

Figure 3B:
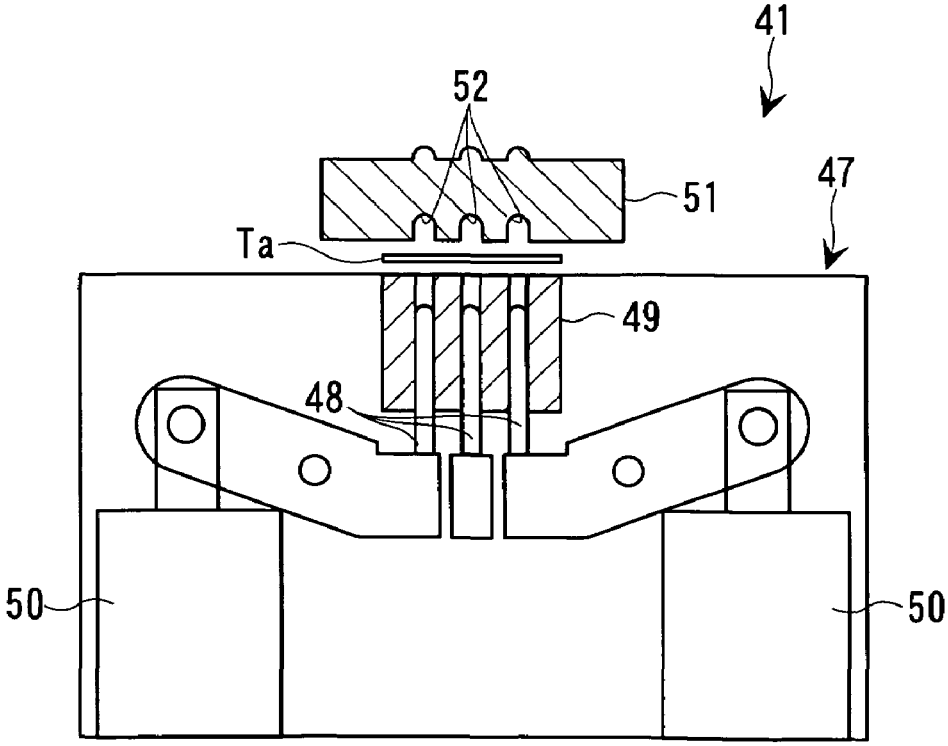

Furthermore, referring to FIG. 3B, the embossing unit 41 is disposed on the downstream side of the tape feed direction with respect to the feed roller 44 and includes an embossing part 47 disposed under the inserted tape piece Ta and an embossing reception unit 51 disposed so as to correspond to the embossing part 47. The embossing part 47 includes three embossing pins 48 arranged so as to correspond to three longitudinal pins of six embossed convex units that constitute a Braille (six-point Braille), an embossing guide block 49 that guides the embossing process operation of the three embossing pins 48 so that it moves forward and backward, and three solenoids 50 serving as driving sources. In the embossing reception unit 51 are formed three reception grooves 52 corresponding to the three embossing pins 48. While the tape feed unit 42 feeds the tape piece Ta, the three embossing pins 48 selectively jump to the reception grooves 52 using the three solenoids 50 as the driving sources. As a result, the embossing operation is executed and the embossed convex units of the so-called six-point Braille are formed on the tape piece Ta.

Figure 4:
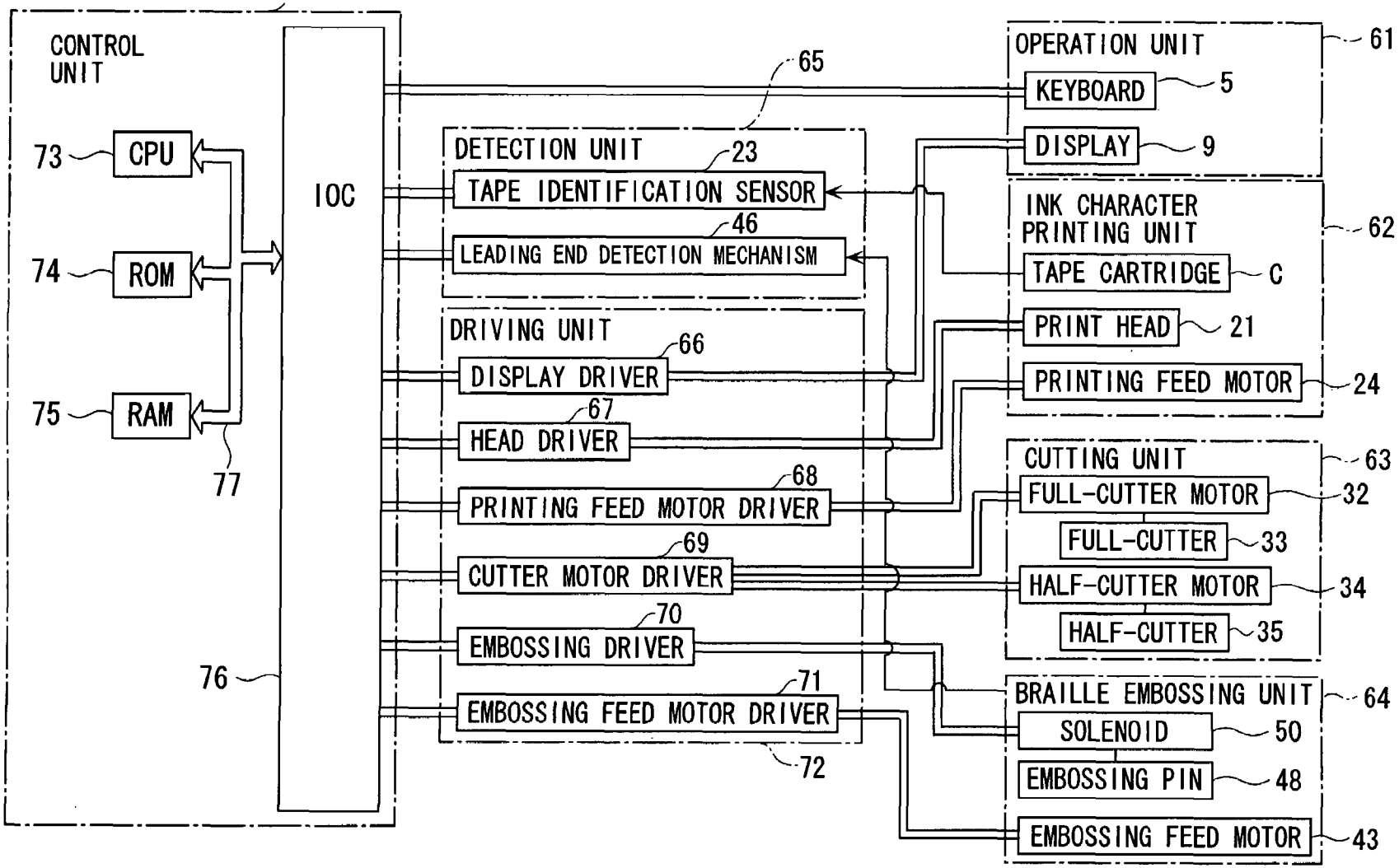
FIG. 4 is a control block diagram of the label making apparatus.

The construction of a control system of the label making apparatus 1 will be described below with reference to FIG. 4. The label making apparatus 1 includes an operation unit 61, an ink character printing unit 62 and a cutting unit 63. The operation unit 61 includes the keyboard 5 and the display 9 and is responsible for user interface, such as the input of character information from a user and the display of a plurality of information. The ink character printing unit 62 includes the tape cartridge C, the print head 21 and the printing feed motor 24, and prints ink character data on the processing tape T according to input character information while the processing tape T and the ink ribbon R are fed. The cutting unit 63 includes the full-cutter 33, the half-cutter 35, the full-cutter motor 32 for driving the full-cutter 33 and the half-cutter motor 34 for driving the half-cutter 35. The cutting unit 63 performs the full-cut and half-cut processes on the processing tape T on which the printing process has been completed.

The label making apparatus 1 further includes a Braille embossing unit 64, a detection unit 65, a driving unit 72 and a control unit 60. The Braille embossing unit 64 includes the solenoids 50, the embossing pins 48 and the embossing feed motor 43. The Braille embossing unit 64 performs the Braille embossing process on the tape piece Ta using Braille data according to character information while the tape piece Ta is feed. The detection unit 65 includes a plurality of sensors, such as the tape identification sensor 23 and the leading end detection mechanism 46, and it performs various detection operations. The driving unit 72 includes the display driver 66, the head driver 67, the printing feed motor driver 68, the cutter motor driver 69, the embossing driver 70 and the embossing feed motor driver 71. The driving unit 72 drives the above-mentioned drivers. The control unit 60 is connected to the individual elements and controls the entire operation of the label making apparatus 1.

The control unit 60 includes a CPU 73, a ROM 74, a RAM 75 and an Input Output Controller (IOC) 76. The CPU 73, the ROM 74, the RAM 75, and the IOC 76 are interconnected by an internal bus 77. The CPU 73 receives a plurality of signals and data from each element of the label making apparatus 1 through the IOC 76 according to the control program of the ROM 74. The CPU 73 also processes various data within the RAM 75 according to a plurality of received signals and data, and outputs the processed data to each element of the label making apparatus 1 through the IOC 76. Accordingly, the ink character printing process, the Braille embossing process and so on can be controlled.

Through such control, a plurality of processes can be performed on the processing tape T. For example, the processing tape T may undergo the ink character printing process and may be then cut in order to obtain the tape piece Ta. Braille may be then embossed in order to obtain the tape piece Ta on which both the ink character printing process and the Braille embossing process have been performed, or only the ink character printing process may be performed on the processing tape T which is then cut in order to obtain the tape piece Ta without performing the Braille embossing process. Alternatively, after the processing tape T is cut in order to obtain the tape piece Ta without performing the ink character printing process, only the Braille embossing process may be carried out. In addition, after such processes, the tape piece Ta is adhered to a desired object in a form of an ink character and Braille written label, an ink character label, or a Braille label.

Figures 5A, 5B:
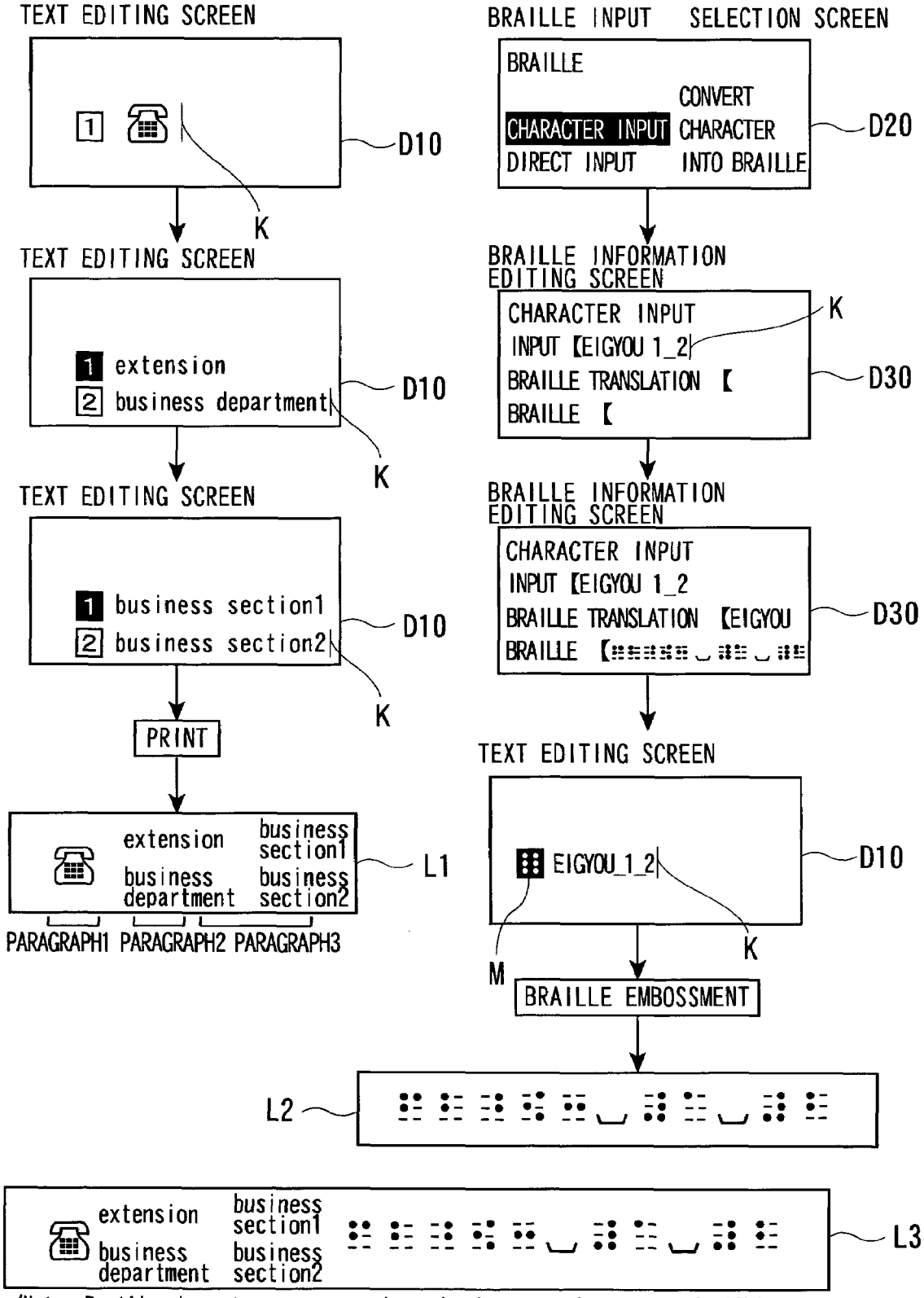
FIGS. 5A and 5B are views illustrating an order of inputting ink character information and Braille information along the displayed screen.

An order of inputting character information (input information), for performing the ink character printing process and the Braille embossing process in accordance with the label making apparatus 1 of the present embodiment will be described below. FIG. 5A illustrates an order of inputting ink character information (i.e., character information for ink character printing). In a general text editing screen D10, a user first inputs for example, 'telephone (symbol)' by operating a predetermined key using the keyboard 5. The user then adds an input section and inputs 'extension' (a first row) and 'business department' (a second row) thereto. Next, the user then adds a section and inputs 'business section 1' (a first row) and 'business section 2' (a second row) thereto. Thereafter, if the execution of printing is instructed by the user, the label making apparatus 1 begins the ink character printing process and writes a label L1 as shown in FIG. 5A. Ink character information consisting of three sections (a section 1 to a section 3) is printed on the label L1 by the input operation.

Meanwhile, FIG. 5B illustrates an order of inputting Braille information (i.e., character information (input information) for Braille embossing). A user first displays a Braille input selection screen D20 from a general text editing screen D10 by operating a predetermined key. The Braille input selection screen D20 is a screen on which Braille information will be input either through general character input or by directly indicating, a point to be embossed, the indication point to be embossed then being input. When the method of inputting Braille information is set on the Braille input selection screen D20 ('character input' is set in FIG. 5B), a Braille information editing screen D30 is displayed. The user inputs character information for Braille embossing on the Braille information editing screen D30 (in FIG. 5B, 'EIGYOU 1_2' (which means 'business 1_2' in English) is input ('_' designates space)). Note that the string of EIGYOU is a transliteration of the Japanese characters meaning business in English, and the braille characters as seen in FIG. 5B correspond to the string of EIGYOU. Therefore, 'business section 1' and 'business section 2' in FIG. 5A correspond to 'EIGYOU 1_2' in FIG. 5B.

When the user confirms the input of the Braille information by operating a predetermined key, the Katakana characters (Japanese characters denoted by an uppercase letter) and Braille translation are preview displayed on the Braille information editing screen D30 as well as the Hiragana characters (Japanese character denoted by a lowercase letter) of the confirmed Braille information. (As described, however, the characters displayed on the Braille information editing screen D30 are actually the transliteration of the Japanese characters so as to correspond to the braille characters.) If the user views the preview display and then presses a key, such as a confirm key, of the keyboard 5, the screen shifts to the text editing screen D10 on which the input character information for Braille embossing is displayed. Meanwhile, in FIG. 5B, reference character M designates a Braille mark indicating that displayed character information is character information for Braille embossing. A cursor K is disposed at the end of the character information. Thereafter, when the user instructs the Braille embossing process to be executed, the label making apparatus 1 begins the Braille embossing process and writes a label L2 as shown in FIG. 5B. Braille information 'EIGYOU_1_2' (which means 'business_1_2' in English) is embossed in the label L2 by the input operation. Alternatively, ink character information input according to the order shown in FIG. 5A and Braille information input according to the order shown in FIG. 5B are printed and embossed on the same tape T, and a label L3 (see the bottom of FIG. 5B) in which both ink characters and Braille characters are written is made. In addition, though a detailed description will not be given, the user may input (edit) ink character information and Braille information by designating an editing location using the cursor K, and inputting information and location information about the cursor K may be temporarily stored in the RAM 75.

In this case, the delete menu displayed by the label making apparatus 1, for allowing a user to simply delete information input as ink character information or Braille information through simple operation, will be described below. The delete menu includes a plurality of delete options. In the present embodiment, the delete menu including three delete options, such as 'delete whole text' for batch-deleting input information and returning the format setting such as character size or margin setting and layout setting to an initial state, 'delete section' for deleting ink character information on a section basis, and 'delete braille' for batch-deleting Braille information, is stored in the ROM 74 (see FIG. 4). At this time, the delete menu is displayed by operating a predetermined key by a user as a trigger when the text editing screen D10 (see FIG. 5A) is displayed.

Figure 6:
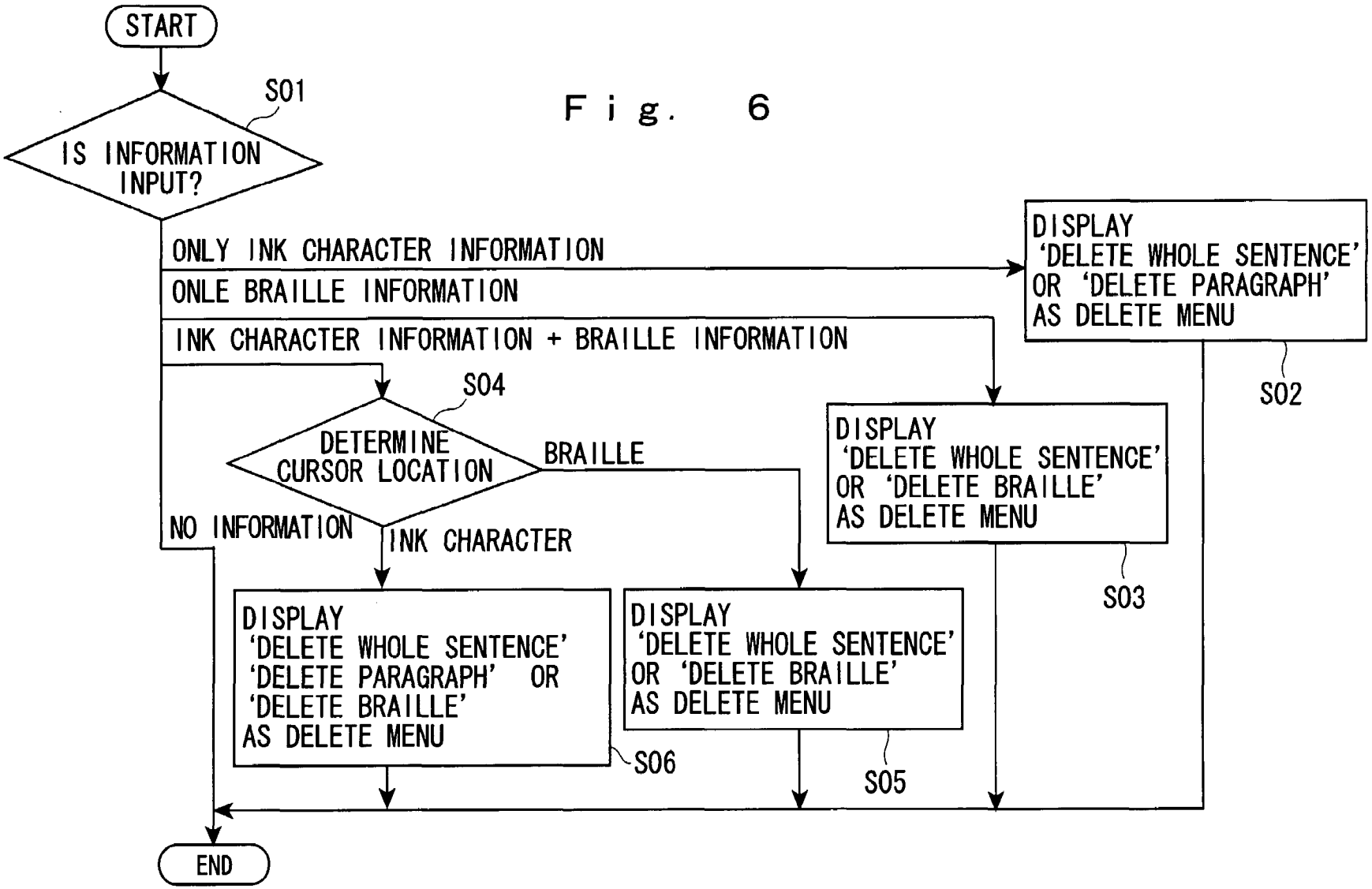
FIG. 6 is a flowchart illustrating the display order of the delete menu.

FIG. 6 is a flowchart illustrating an order of displaying the delete menu. If the display of the delete menu is instructed by a user, the label making apparatus 1 first determines whether information is input with reference to the RAM 75 (S01). If it is determined that the input information is only ink character information (S01: only ink character information), it means that information to be deleted is only the ink character information. Therefore, the label making apparatus 1 determines the delete options, which will be displayed, as 'delete whole text' and 'delete section', and then displays them on the display 9 as the delete menu (S02). Meanwhile, if it is determined that the input information is only Braille information (SO1: only Braille information), it means that information to be deleted is only the Braille information. Accordingly, the label making apparatus 1 determines the delete options, which will be displayed, as 'delete whole text' and 'delete braille', and then displays them on the display 9 as the delete menu (S03). Meanwhile, if it is determined that the input information is both ink character information and Braille information (SO1: ink character information+Braille information), the label making apparatus 1 determines a location (hereinafter, referred to as a 'cursor location') of the cursor K in the text editing screen D10 (S04).

If the cursor location is at the Braille information (S04: Braille), the label making apparatus 1 determines the delete options, which will be displayed, as 'delete whole text' and 'delete braille', and then displays them on the display 9 as the delete menu (S05). On the other hand, if the cursor location is at the ink character information (S04: ink character), the label making apparatus 1 determines the delete options, which will be displayed, as 'delete whole text', 'delete section' and 'delete braille', and then displays them on the display 9 as the delete menu (S06). Meanwhile, if no information is input as the input information (SO1: no input), that is, no information is input in the text editing screen D10 (see FIG. 7B), the label making apparatus 1 does not display the delete menu and then finishes the process.

Figure 7A:
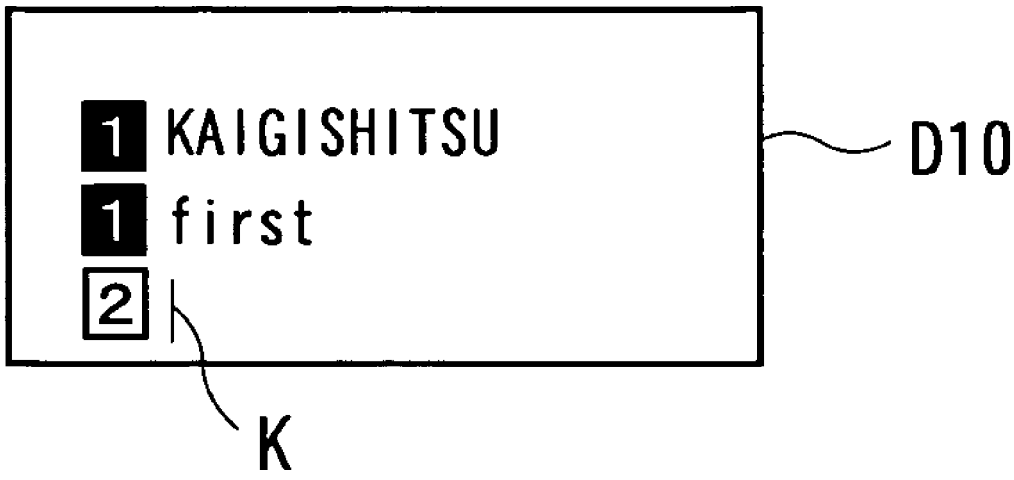
FIGS. 7A and 7B are views illustrating a plurality of input states on the text editing screen.
Figure 7B:
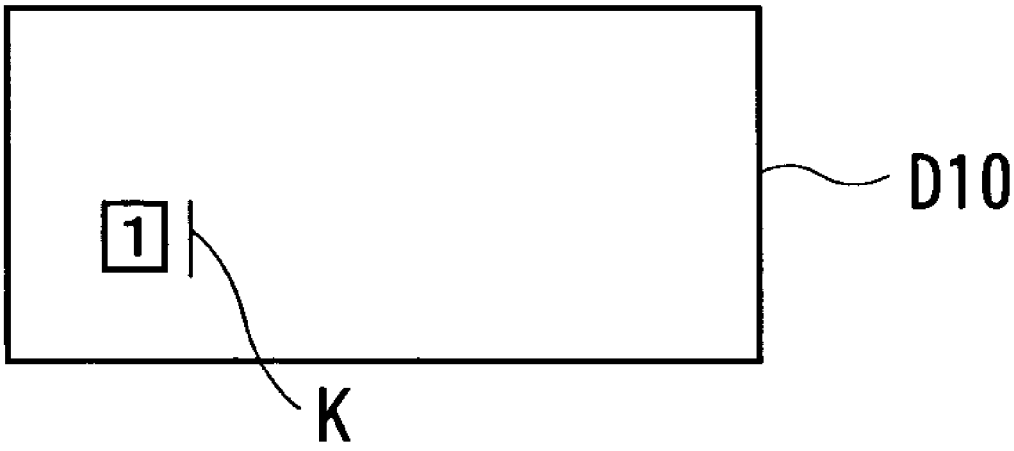

Furthermore, the term 'cursor location is at the ink character information' refers to an example in which the cursor K is located at the front (such as immediately after line feed) as shown in the text editing screen D10 of FIG. 7A. However, when there is nothing input such as ink characters (including spaces) as shown in the text editing screen D10 of FIG. 7B, the label making apparatus 1 determines that 'there is no ink character information' even if the cursor K is located at the front. Alternatively, when determining the input information (corresponding to SO1), the process (corresponding to S03) of determining that ink character information always exists and that the input information is 'only braille information' may be omitted. Furthermore, if ink character information and Braille information are input, the cursor location is not determined (corresponding to S04), and all of the delete options, such as 'delete whole text', 'delete section' and 'delete braille', may be displayed.

Furthermore, the delete option 'delete section' may mean that ink character information of a section, at which the cursor K is located, of input ink character information, will be deleted. In addition, when the input information is only ink character information (corresponding to S02) or the input information is ink character information and Braille information and the cursor is located at ink character information (corresponding to S06), the label making apparatus 1 may again determine whether ink character information has been input at a plurality of sections. As a result of the determination, only when the ink character information is input at the plurality of sections, the delete option 'delete section' can be displayed. Furthermore, if only the ink character information is input (corresponding to S02), the delete option 'delete whole text' displayed as the delete menu may batch-delete the whole input ink character information and at the same time, or may return the format setting in regards to the ink character information to its initial state. If only the Braille information is input (corresponding to S03), the delete option 'delete whole text' displayed as the delete menu may batch-delete the whole input Braille information and at the same time, or may return the format setting in regards to Braille information to its initial state. In a similar way, if both the ink character information and the Braille information are input (corresponding to S05 or S06), the delete option 'delete whole text' displayed as the delete menu may batch-delete the whole input ink character information and Braille information and at the same time, or may return the format setting in regards to the ink character information and the Braille information to their initial states.

Figure 8A:
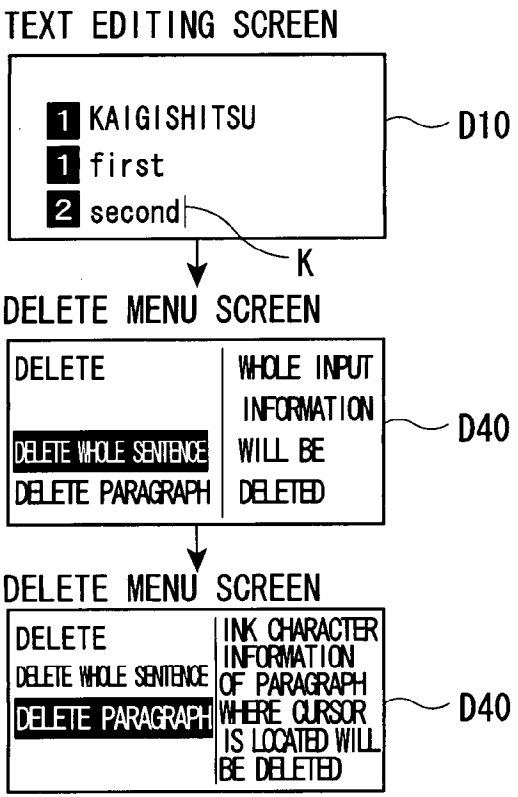
FIGS. 8A and 8B are views illustrating a delete menu to be displayed on the basis of input information.
Figure 8B:
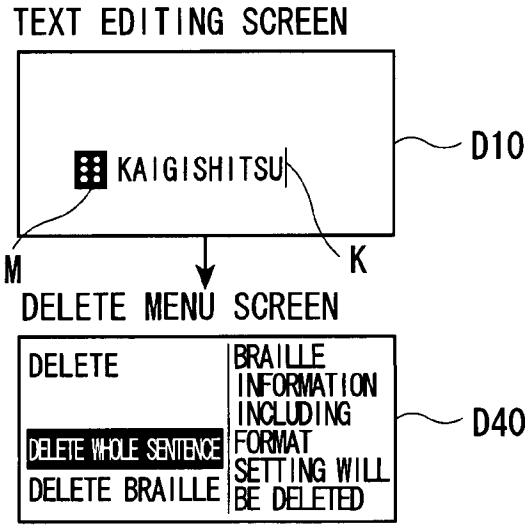

Furthermore, description will specifically be given with reference to FIGS. 8A and 8B and FIGS. 9A and 9B. FIG. 8A illustrates the delete menu displayed when only ink character information is input. FIG. 8B illustrates the delete menu displayed when only Braille information is input. For example, in the case that 'KAIGISHITSU' (which means 'conference room' in English) (a section 1; a first row) 'first' (a section 2; a first row) and 'second' (a section 2; a second row) are input as the ink character information as shown in FIG. 8A, if a user instructs the display of the delete menu in the text editing screen D10, the label making apparatus 1 determines 'delete whole text' and 'delete section' from among a plurality of delete options as delete options to be displayed and then displays them on the delete menu screen D40.

In the delete menu screen D40, the delete option 'delete whole text' has been selected in an initial state, and the user can select the delete option 'delete section' through the manipulation of a predetermined key. If the user selects the delete option 'delete whole text', the whole input ink character information is deleted and at the same time, format setting regarding the ink character information is returned to its initial state. Meanwhile, if the user selects the delete option 'delete section', information about a section at which the cursor K is located is deleted (since the cursor K is located at the 'second' letter string belonging to 'section 2' in FIG. 8A, 'one' and 'two' belonging to 'section 2' are deleted). Meanwhile, in the event that 'KAIGISHITSU' (which means 'conference room' in English) is input as the Braille information as shown in FIG. 8B, if a user instructs the display of the delete menu in the text editing screen D10, the label making apparatus 1 determines 'delete whole text' and 'delete braille' from among a plurality of delete options as the delete options to be displayed and then displays them on the delete menu screen D40. In the delete menu screen D40, the delete option 'delete whole text' has been selected in an initial state and the user can select the delete option 'delete braille' by operating a predetermined key. If the user selects the delete option 'delete whole text', the whole input Braille information is deleted and, at the same time, format setting regarding the Braille information is returned to the initial state. If the user selects the delete option 'delete braille', the whole input Braille information is deleted.

FIGS. 9A and 9B illustrate the delete menus displayed when both ink character information and Braille information are input. FIG. 9A illustrates an example in which the cursor location is at a letter string of Braille information. FIG. 9B illustrates an example in which the cursor location is at a letter string of ink character information. For example, as shown in FIG. 9A, in the case that 'KAIGISHITSU' (which means 'conference room' in English) (a section 1; a first row), 'first' (a section 2; a first row) and 'second' (a section 2; a second row) are input as the ink character information and the Braille information 'KAIGISHITSU' (which means 'conference room' in English) is input, if a user instructs the display of the delete menu in the text editing screen D10, the label making apparatus 1 sets 'delete whole text' and 'delete braille' as the delete menus since the cursor location is at the letter string of the Braille information, and then displays them on the delete menu screen D40. Note that the string of KAIGISHITSU described above is a transliteration of the Japanese characters meaning conference room in English.

In the delete menu screen D40, 'delete braille' has been selected in an initial state and the user can select 'delete whole text' by operating a predetermined key. If the user selects the delete option 'delete braille', the whole input Braille information is deleted. If the user selects the delete option 'delete whole text', the whole input ink character information and Braille information are batch-deleted and at the same time, and the format settings regarding the ink character information and the Braille information are returned to their initial states. Meanwhile, as shown in FIG. 9B, in the case that the input ink character information and Braille information are the same as in the example shown in FIG. 9A, and the cursor location is at the letter string of the ink character information, if a user instructs the display of the delete menu in the text editing screen D10, the label making apparatus 1 determines 'delete whole text', 'delete section' and 'delete braille' as the delete options to be displayed since the cursor location is at the letter string of the ink character information, and then displays them on the delete menu screen D40.

In the delete menu screen D40, the delete option 'delete section' has been selected in the initial state and the user can select the delete option 'delete whole text' or 'delete braille' by operating a predetermined key. If the user selects the delete option 'delete section', 'conference room' belonging to 'section 1', at which the cursor K is located, of the ink character information, is deleted. Furthermore, if the user selects the delete options 'delete whole text' and 'delete braille', the process is the same as that shown in FIG. 9A. Therefore, a detailed description thereof will be omitted. Furthermore, in the delete menu screen D40, the outline of the delete options that are selected is displayed on the right part of the screen. Accordingly, a user can easily know which information will be deleted when selecting the delete option 'delete whole text', 'delete section' or the like.

As described above, the label making apparatus 1 according to the embodiments of the present invention determines the delete options to be displayed on the basis of input information and then displays a delete menu. Therefore, since unselectable delete options are not displayed, there is no possibility for a user to be confused. Furthermore, delete options can be determined on the basis of a cursor location and is then displayed on the delete menu screen. It is therefore possible to further improve user operation. In addition, when Braille information is input, a concept called 'section' is created in the same manner as ink character information. Accordingly, Braille information can be specified on a section basis even when deleting the Braille information.

Furthermore, it is to be understood that each element (each function) of the above-described label making apparatus 1 may be provided as a program. The program may be stored in a recording medium (not shown) to be provided. The recording medium may be a CD-ROM, a flash ROM, or a memory card (such as compact flash (trademark), smart media, a memory stick, and so on). Alternatively, a compact disk, a magnetic optical disk, Digital Versatile Disk (DVD), a flexible disk or the like may also be used as the recording media.

While the present invention has been described with reference to the particular illustrative embodiments, it is not to be restricted by the embodiments but only by the appended claims. Furthermore, the construction, the processes and/or the like of the label making apparatus 1 may be adequately modified in various ways without departing from the scope and spirit of the present invention.

What is claimed is:

1. An information processing apparatus comprising:

an input device that allows input of a plurality of information so as to allow performance of a plurality of processes;

an input information display device that displays input information that is the input one or more kinds of information;

a delete menu storage device that stores a delete menu having a plurality of delete options; and a delete menu display device that displays only delete options corresponding to the information input by the input device from among the plurality of delete options, as the delete menu, wherein the plurality of information includes ink character information for performing ink character printing and Braille information for performing Braille embossing, the delete menu display device determines the delete options to be displayed on the basis of whether the Braille information exists in the input information, and then displays the delete menu, the delete menu includes delete options such as 'delete whole text' that batch-deletes the input information, 'delete section' that deletes the ink character information on a section basis, and 'delete Braille' that batch-deletes the Braille information, the delete menu display device displays 'delete whole text' and 'delete section' as the delete options only if the ink character information is input as the input information, the delete menu display device displays 'delete whole text' and 'delete Braille' as the delete options only if the Braille information is input as the input information, and the delete menu display device displays 'delete whole text', 'delete section', and 'delete Braille' as the delete options if the ink character information and the Braille information are input as the input information.

2. The information processing apparatus according to claim 1, wherein the input information display device further displays a cursor for marking an editing location of the input information, and the delete menu display device determines the delete options to be displayed on the basis of the location of the cursor, and then displays the delete menu.

3. A printing and embossing complex apparatus comprising:

an information processing apparatus according to claim 1;

an ink character printing device that prints ink characters on a processing sheet on the basis of the ink character information; and a Braille embossing device that embosses Braille characters on the processing sheet on the basis of the Braille information.

4. A program encoded in a computer-readable medium for allowing a computer to operate as each device of an information processing apparatus according to claim 1.

5. An information processing apparatus comprising:

an input device that allows input of a plurality of information so as to allow performance of a plurality of processes;

an input information display device that displays input information that is the input one or more kinds of information;

a delete menu storage device that stores a delete menu having a plurality of delete options; and a delete menu display device that displays only delete options corresponding to the information input by the input device from among the plurality of delete options, as the delete menu, wherein the plurality of information includes ink character information for performing ink character printing and Braille information for performing Braille embossing, the delete menu display device determines the delete options to be displayed on the basis of whether the Braille information exists in the input information, and then displays the delete menu, the input information display device further displays a cursor for marking an editing location of the input information, in the case that the ink character information and the Braille information are input as the input information, the delete menu display device displays 'delete whole text', 'delete section', and 'delete Braille' as the delete options if the cursor is located at the ink character information, and the delete menu display device displays 'delete whole text' and 'delete Braille' as the delete options if the cursor is located at the Braille information.

* * * * *